US009463853B2

(12) United States Patent
Brautaset et al.

(10) Patent No.: US 9,463,853 B2
(45) Date of Patent: Oct. 11, 2016

(54) PROPELLER PROPULSION SYSTEM FOR FLOATING STRUCTURES

(75) Inventors: Henning Brautaset, Orsta (NO); Roald Håvik, Austefjord (NO)

(73) Assignee: Scana Volda AS, Volda (NO)

( * ) Notice: Subject to any disclaimer, the term of this patent is extended or adjusted under 35 U.S.C. 154(b) by 617 days.

(21) Appl. No.: 13/638,532

(22) PCT Filed: Mar. 31, 2011

(86) PCT No.: PCT/NO2011/000115
§ 371 (c)(1),
(2), (4) Date: Nov. 16, 2012

(87) PCT Pub. No.: WO2011/122962
PCT Pub. Date: Oct. 6, 2011

(65) Prior Publication Data

US 2013/0064664 A1 Mar. 14, 2013

(30) Foreign Application Priority Data

Mar. 31, 2010 (NO) ..... 20100479

(51) Int. Cl.
*B63H 1/02* (2006.01)
*B63H 23/02* (2006.01)
*B63H 21/17* (2006.01)

(52) U.S. Cl.
CPC ..... *B63H 1/02* (2013.01); *B63H 21/17* (2013.01); *B63H 23/02* (2013.01)

(58) Field of Classification Search
CPC ..... B63H 1/02; B63H 21/17; B63H 23/02; B63H 21/30; B63H 21/305; B64D 35/00
USPC ..... 416/170 R; 440/75, 111
See application file for complete search history.

(56) References Cited

U.S. PATENT DOCUMENTS 3,105,455 A 10/1963 Baldwin
3,207,118 A * 9/1965 Baldwin ..... 440/75

(Continued)

FOREIGN PATENT DOCUMENTS

CN 101565101 A 10/2009
DE 2615739 B1 9/1977

(Continued)

OTHER PUBLICATIONS

Chinese Office Action for Application No. 2011800232056, mailed on Aug. 5, 2014 (8 pages).

(Continued)

*Primary Examiner* — Richard Edgar
*Assistant Examiner* — Brian P Wolcott
(74) *Attorney, Agent, or Firm* — Osha Liang LLP

(57) ABSTRACT

A floating structure has a hull and a propeller propulsion system having a gear arrangement that is connected via a first intermediate shaft to at least one electromotor, the electromotor being arranged onboard the floating structure, and via a second intermediate shaft to a propeller. The gear arrangement has an angular gear. The first intermediate shaft forms an angle relative to the second intermediate shaft. The gear arrangement is arranged as a separate unit in an appendage or addition to the hull of the floating structure. The appendage or addition is designed to allow an interior thereof to be accessed from within the vessel, whereby maintenance, replacement, or repairs of the gear arrangement can be carried out. The angular gear has at least one angled gearwheel set and one cylindrical gearwheel set.

5 Claims, 5 Drawing Sheets

(56) References Cited

U.S. PATENT DOCUMENTS

| | | | | |
|---|---|---|---|---|
| 3,601,989 | A | 8/1971 | Austin | |
| 3,734,050 | A * | 5/1973 | Kitai et al. | 440/59 |
| 3,788,266 | A | 1/1974 | Strang | |
| 3,914,556 | A * | 10/1975 | Frazee | 379/379 |
| 8,585,366 | B2 * | 11/2013 | Shuto et al. | 416/129 |
| 2006/0073747 | A1 | 4/2006 | Harada et al. | |
| 2007/0123118 | A1 * | 5/2007 | White et al. | 440/75 |
| 2008/0166934 | A1 * | 7/2008 | Levander et al. | 440/58 |
| 2009/0124146 | A1 | 5/2009 | Reuter et al. | |

FOREIGN PATENT DOCUMENTS

| | | | |
|---|---|---|---|
| EP | 0509712 | A1 | 10/1992 |
| FR | 2248976 | | 5/1975 |
| FR | 2347577 | | 4/1977 |
| GB | 2028746 | A | 3/1980 |
| GB | 2313819 | A | 12/1997 |
| JP | 55-061096 | U | 4/1980 |
| JP | 63-006257 | U | 1/1988 |
| JP | 6-336936 | A | 12/1994 |
| JP | 2006-117160 | A | 5/2006 |
| WO | 98/13256 | A1 | 4/1998 |
| WO | WO 2009/087831 | A1 * | 7/2009 |

OTHER PUBLICATIONS

International Search Report issued in PCT/NO2011/000115, mailed on Jun. 30, 2011 (4 pages).

International Preliminary Report on Patentability issued in PCT/NO2011/000115, mailed on Sep. 17, 2012, with response to Written Opinion dated Aug. 9, 2012 (8 pages).

Norwegian Search Report issued in parent case NO20100479, dated Oct. 29, 2010 (1 page).

* cited by examiner

PROPELLER PROPULSION SYSTEM FOR FLOATING STRUCTURES

BACKGROUND

1. Field of the Invention

The present invention relates to a compact, conventional propeller propulsion system for a floating structure, and more specifically the present invention relates to the arrangement and use of a gear arrangement comprising an angular gear in an addition to the hull of the floating structure.

2. Description of Related Art

A floating structure may comprise different types of vessels, semi-submersible platforms, barges etc., the pontoons of the semi-submersible platform then being capable of being regarded as forming a hull of the floating structure.

In connection with the offshore production of oil and gas there are a number of vessels that are adapted to carry out a very few specialised operations. Steadily increasing and more demanding activities offshore have however led to the development of a number of different types of so-called OVS vessels (Offshore Support Vessels), which are vessels that are able to carry out a far higher number of operations and/or services than conventional specialised vessels. This has resulted in such multipurpose vessels having a greater number of persons on board the vessel, in view of the fact that one or more persons will be responsible for their own work tasks. As a consequence of this, these vessels will in the future be subject to a new and more stringent legislative regime, which will include more rigorous requirements concerning the division of the vessel into watertight sections.

The forthcoming rule changes will be difficult to comply with in the case of some types of OVS vessels, for example, anchor handling vessels, as these vessels are built with long propeller shafts extending through large parts of the vessel (diesel-mechanical solutions). These types of solutions take up a great deal of space, thereby substantially reducing the vessel's load capacity. In view of this, a number of vessels have been built with diesel-electrical solutions, which has resulted in a reduction in the length of the propeller shafts. Such solutions will also be more attractive when the propulsion system is used on low-load and part-load rather than pure diesel-mechanical solutions.

Another type of solution which has eliminated the long propeller shafts is so-called azimuth thrusters, which thrusters are used for both propulsion and manoeuvring of the vessel. An azimuth thruster is a separate unit that is mounted in a receiving space in the vessel, and which can be turned 360° about its own axis. Such solutions will however mean that the vessel will have to dock during maintenance, replacement or repairs of the azimuth thruster. Angle drives and gearwheels in such an azimuth thruster will moreover be far more subject to wear and damage, as the pushing and pulling force of the propeller will result in the angle drives and gearwheels being displaced relative to each other, which will mean that they are subjected to greater loads.

SUMMARY

One or more embodiments of the present invention provides a propeller propulsion system for a floating structure.

One or more embodiments of the present invention provides a compact propeller propulsion system for a floating structure, where the propeller propulsion system will free up space on board in the floating structure.

One or more embodiments of the present invention provides a compact propeller propulsion system for floating structures where the need for docking during maintenance, repair etc, of the propeller propulsion system is reduced.

One or more embodiments of the present invention provides a compact propeller propulsion system for a floating structure, where the propeller propulsion system is less subject to wear, damage etc.

One or more embodiments of the present invention provides a compact propeller propulsion system for a floating structure which minimises the risk of the spillage of oil, fuel etc.

According to one or more embodiments of the present invention, a propeller propulsion system for a floating structure comprises a hull, the propeller propulsion system comprising at least one sub-system, the sub-system further comprising a gear arrangement which via a first intermediate shaft is connected to at least one electromotor and a via a second intermediate shaft is connected to a propeller. The gear arrangement is further arranged as a separate unit in an appendage or addition to the hull of the floating structure, whilst the at least one electromotor is arranged on board in the floating structure. The at least one electromotor will further be arranged at an angle relative to the second intermediate shaft.

The propellers according to one or more embodiments of the present invention are a variable propeller (adjustable propeller blades) and may further be arranged in a propeller shroud.

The propeller propulsion system for floating structures according to one or more embodiments of the present invention may also comprise a rudder arranged behind the propellers close to a rear end of the floating structure, whereby the rudder is used to steer or manoeuvre the floating structure.

That the at least one electromotor is arranged at an angle relative to the second intermediate shaft should be taken to mean that an axis (E, A) runs through the electromotor which is an extension of the intermediate shaft to which the electromotor is connected, which axis will form an angle with an axis (P, A) which runs through the intermediate shaft to which the propeller is connected. The angle between the two axes E, A and P, A will then, for example, be between 20° and 160°.

The above arrangement will mean that the at least one electromotor can be arranged both ahead of and behind the gear arrangement that is arranged in the appendage or addition to the hull of the floating structure.

A person of skill in the art will know how the gear arrangement of the propeller propulsion system according to one or more embodiments of the present invention should be arranged and supported in the appendage or addition to the hull of the floating structure and therefore this will not be discussed further here. As the at least one electromotor is arranged at an angle relative to the second intermediate shaft, the gear arrangement will comprise an angular gear.

The angular gear, in order to be able to transmit a revolution from the at least one electromotor to the propeller, will be configured with an incoming shaft (to which incoming shaft the at least one electromotor is connected via the first intermediate shaft) and an outgoing shaft (to which outgoing shaft the propeller is connected via the second intermediate shaft).

The propeller propulsion system for a floating structure according to one or more embodiments of the present invention may also, however, comprise two electromotors which are coupled in parallel, the angular gear in this case comprising two incoming shafts and one outgoing shaft. In this case, the two incoming shafts may be arranged parallel to each other or forming an angle relative to each other.

The angular gear comprises at least two reduction gears, where one of the reduction gears will be constituted of an angled gearwheel set, whilst the other reduction gear will be constituted of a cylindrical gearwheel set, which gearwheel sets are arranged in a gear case. One of the cylindrical gearwheels in the cylindrical gearwheel set will then be fixedly connected to a shaft which constitutes the outgoing shaft of the angular gear, whilst the other cylindrical gearwheel will be fixedly connected to an intermediate shaft in the gear case. One angled gearwheel of the angled gearwheel set is also connected to this intermediate shaft. The other angled gearwheel will be fixedly connected to a shaft which constitutes the incoming shaft of the angular gear. In this way, the gearwheels of the cylindrical gearwheel set will be in contact with each other, whilst the gearwheels in the angled gearwheel set will be in contact with each other. Shafts may, for example, be supported by sliding bearings or the like. Through the design of the angular gear described above, an unequal load on the different gearwheels will be prevented to a far greater extent, as the cylindrical gearwheel set is arranged on the outgoing shaft of the angular gear. The pushing and pulling forces of the propeller will result in the outgoing shaft being moved in its longitudinal direction, whereby also the gearwheels of the cylindrical gearwheel set will be displaced in relation to each other. The gearwheels of the cylindrical gearwheel set, because of their design, will be capable of being subjected to greater loads without being worn or damaged, and the angular gear will to a far lesser extent have to be maintained, replaced or repaired.

If the propeller propulsion system according to one or more embodiments of the present invention comprises two electromotors which are coupled in parallel, the angular gear will comprise two angled gearwheel sets. Thus, two angled gearwheel sets will be fixedly connected to the intermediate shaft, one angled gearwheel being arranged on either side of the cylindrical gearwheel. The other angled gearwheels will then be fixedly connected to their respective shafts which constitute the incoming shafts of the angular gear.

Those of skill in the art will know how the teeth of the different gearwheels are to be configured, and therefore this is not discussed further here.

In a propeller propulsion system according to one or more embodiments of the present invention, the gear arrangement will be so arranged that the intermediate shaft which is connected to the angular gear respective the propeller will have a distance to the horizontal base plane that will increase from the gear arrangement backwards towards one end of the floating structure.

The appendages or additions to the hull of the floating structure will be so designed as to allow their interior to be accessed, whereby maintenance, replacement and/or repairs of the gear arrangement can be carried out. The appendages or additions will moreover have a design which gives least possible drag in the water, but which at the same time ensures a good inflow of water to the propellers. A person of skill in the art will know how this is to be done, and therefore it is not described in more detail here.

The propeller propulsion system according to one or more embodiments of the present invention gives a more compact propulsion system compared to the use of conventional long propeller shafts that extend through large parts of the vessel's length, thereby freeing up space in the floating structure, whilst ensuring the accessibility of the propeller propulsion system, such that also the need for docking the floating structure during maintenance, repairs and/or replacement etc. is reduced. This will also be an advantage over other compact propulsion systems, such as azimuth thrusters and similar types of manoeuvre propellers, which systems will not have the same accessibility and thus must to a greater extent use a dry dock during the aforementioned operations. Other advantages over known solutions may be:

- less loss of speed when manoeuvring at speed. When the system is constructed with a rudder arrangement, the floating structure will be manoeuvred by means of the lift that a rudder profile gives, and not by turning the manoeuvre propeller. This is a far more energy-efficient way of manoeuvring at speed, and will give far smaller varying loads on the system during manoeuvring.
- the angular gear with a cylindrical reduction gear as a first reduction gear will allow a much greater migration of the shaft on varying propeller loads than an angled reduction gear, without any danger of damage to the transmission.

BRIEF DESCRIPTION OF THE DRAWINGS

The invention will now be described in connection with a number of embodiments and with reference to the appended drawings, wherein.

DETAILED DESCRIPTION

Embodiments of the invention are described below with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Attached FIGS. 1-5 show for the sake of simplicity the propeller propulsion system according to one or more embodiments of the present invention arranged on a vessel. However, it should be understood that the propeller propulsion system according to one or more embodiments of the present invention is also intended to comprise other floating structures, such as semi-submersible platforms, barges etc., although these structures are not shown in the figures.

Figure 1:
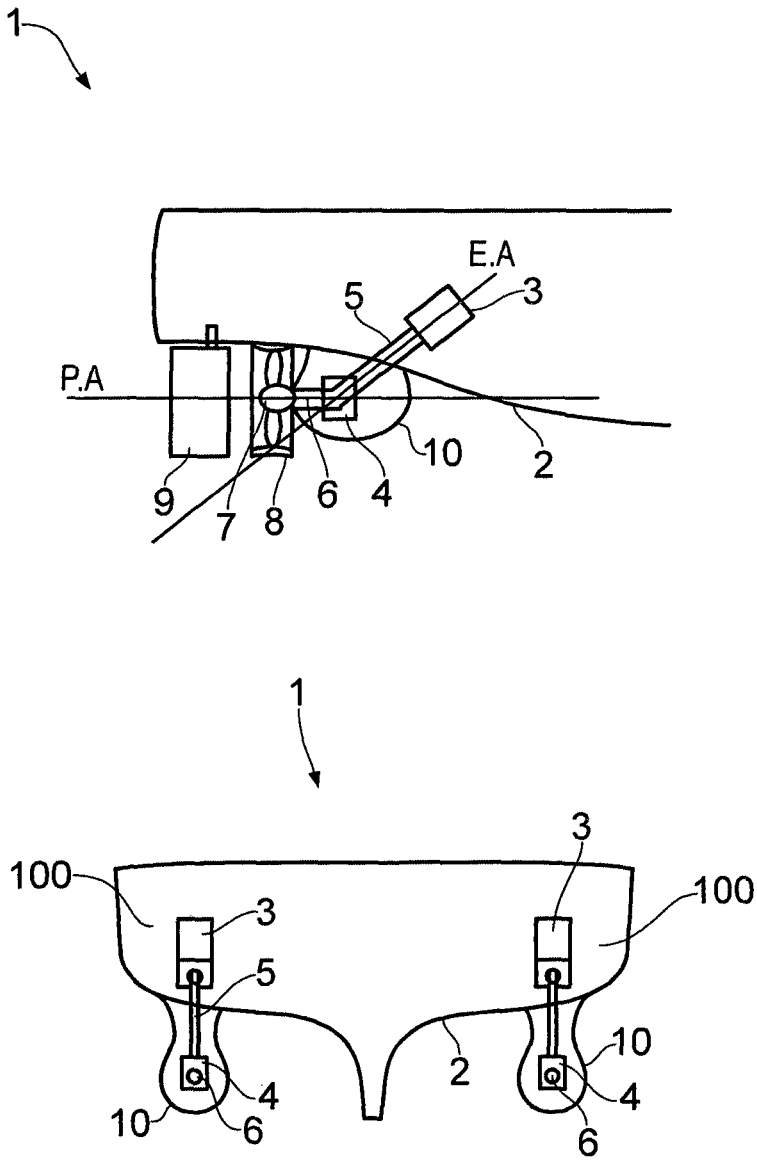
FIG. 1 is a view of a propeller propulsion system according to one or more embodiments of the present invention, seen from the side and from astern.

FIG. 1 shows respectively a side view and a view seen from astern of a stern part of a vessel's 1 hull 2, where a propeller propulsion system according to one or more embodiments of the present invention has been drawn in. The propeller propulsion system comprises at least one sub-system 100, the sub-system 100 comprising one or more electromotors 3, a gear arrangement 4, two intermediate shafts 5, 6 and a propeller 7. Thus, each electromotor 3 is connected via the gear arrangement 4 and the intermediate shafts 5, 6 to the propeller 7. The propeller 7 is arranged in a shroud 8 and may be a fixed or variable propeller. In addition, a rudder 9 is arranged at the stern end of the floating structure 1, lying astern of the propeller 7, whereby the rudder 9 is used to steer or manoeuvre the floating structure 1.

To provide a compact propeller propulsion system according to one or more embodiments of the present invention, the electromotors 3 in the at least one sub-system 100 are arranged on board in the vessel 1 itself, in proximity to the propellers 7, the electromotors 3 being arranged at an angle relative to the propellers 7 when seen in relation to a horizontal base plane H.

To connect each of the electromotors 3 in a sub-system 100 to their respective propellers 7, each of the gear arrangements 4 in the sub-system 100 is arranged in a convexity or addition 10 in the vessel's 1 hull 2. The gear arrangement 4 will comprise an angular gear which will be described below in connection with one or more embodiments of the present invention.

The appendages or additions 10 will be designed to allow access to the gear arrangements 4 from within the vessel, so that necessary maintenance, replacements and/or repairs of the gear arrangement 4 do not necessitate the use of a dock. The convexities or additions 10 will also be designed in such a way that they give least possible drag but at the same time provide a good inflow of water into the propellers 7.

A person of skill in the art will know how the different components of the propeller propulsion system are connected, supported and fixed etc., and so this is not discussed in more detail here.

FIGS. 2A-2D show a propeller propulsion system according to one or more embodiments of the present invention.

Figure 2A:
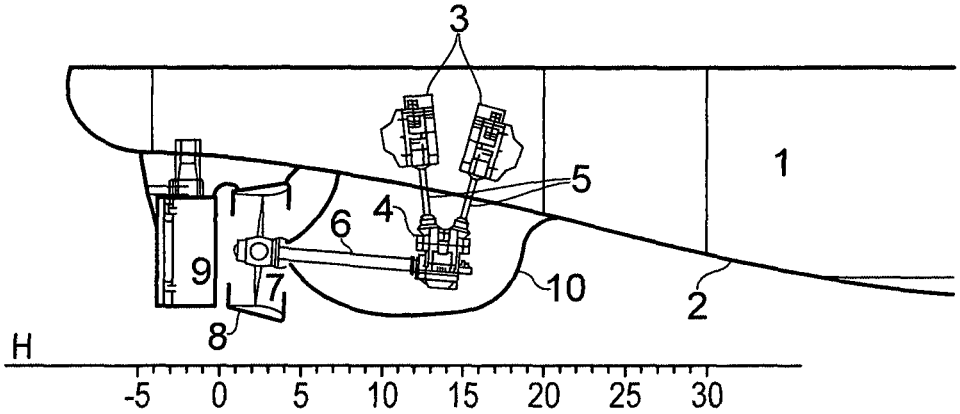
FIGS. 2A-2D show a propeller propulsion system according to one or more embodiments of the present invention.
Figure 4:
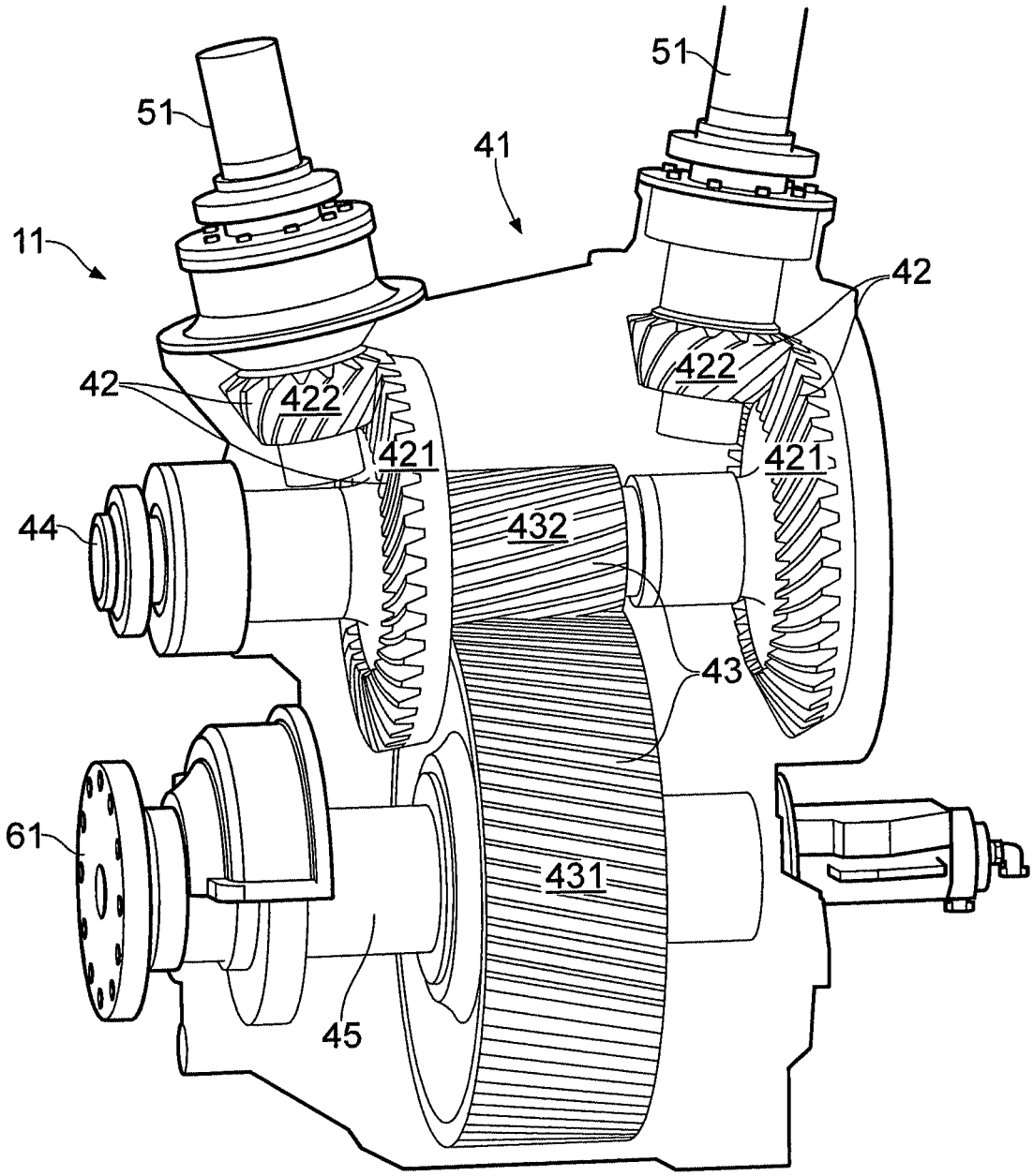
FIG. 4 shows details of a gear arrangement in the propeller propulsion system according to FIG. 2A.

In FIG. 2A, the propeller propulsion system comprises (only one sub-system 100 is shown) two electromotors 3 which are arranged on board at the stern part of the vessel 1, lying above the gear arrangement 4. The electromotors 3 are so arranged that they form an angle relative to one another. Each of the electromotors 3 is further connected, via a first intermediate shaft 5, to the gear arrangement 4, the gear arrangement 4 comprising an angular gear 11 as shown in FIG. 4. The angular gear 11 will be described in more detail in connection with FIG. 4. The angular gear 11 will then be connected to the propeller 7 via the second intermediate shaft 6.

Figure 2B:
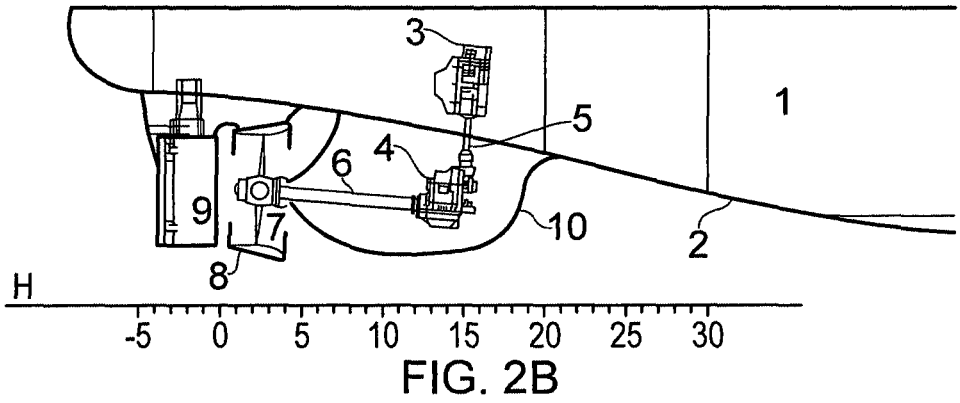

FIG. 2B shows a propeller propulsion system according to one or more embodiments of present invention, where only one electromotor 3 is used in each sub-system 100. The electromotor 3 is arranged at 90 degrees (lying immediately above) relative to the gear arrangement 4. The electromotor 3 is connected via the intermediate shaft 5 to the gear arrangement 4, where the gear arrangement 4 is further connected through the intermediate shaft 6 to the propeller 7.

Figure 2C:
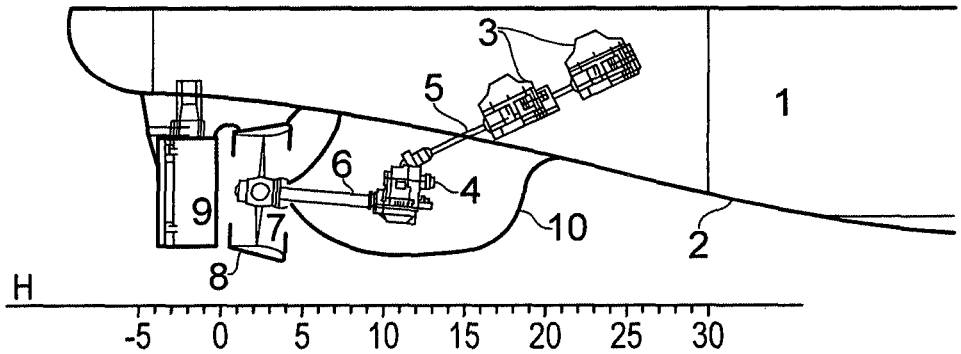
Figure 5:
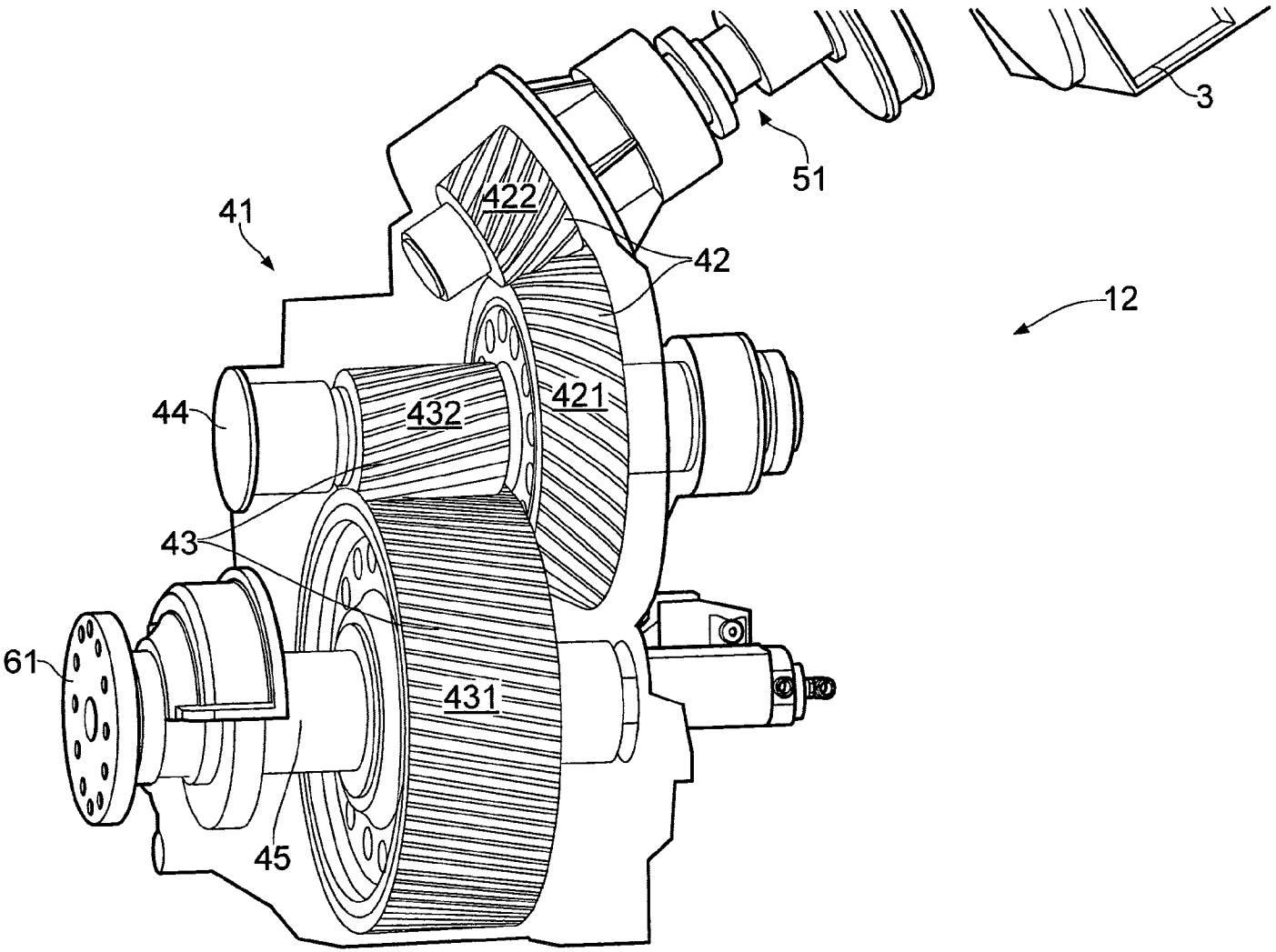
FIG. 5 shows details of a gear arrangement in the propeller propulsion system according to FIG. 2C or 2D.

A propeller propulsion system according to one or more embodiments of the present invention is shown in FIG. 2C, from where it can be seen that two electromotors 3 in each sub-system 100 are connected in series. The electromotors 3 are also located ahead of the gear arrangement 4, but at an angle relative to the gear arrangement 4 when seen in relation to the horizontal base plane H. The gear arrangement 4 in one or more embodiments of the present invention comprises an angular gear 12 as shown in FIG. 5, which angular gear 12 will be explained in more detail in connection with FIG. 5.

Figure 2D:
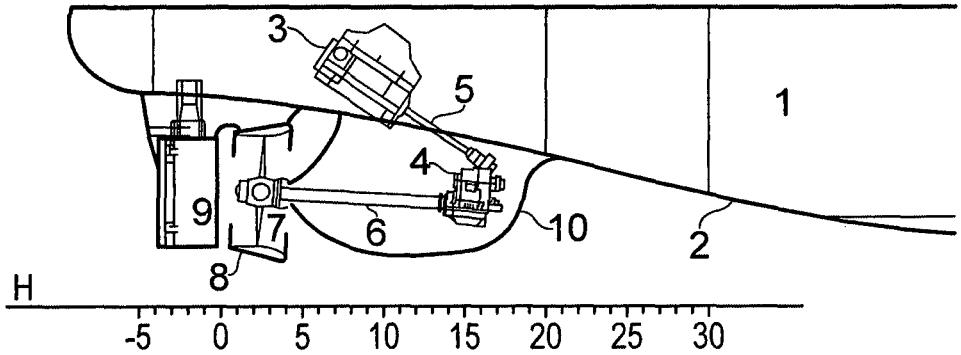

FIG. 2D shows a propeller propulsion system according to one or more embodiments of the present invention, where only one electromotor 3 is used in each sub-system 100, which is arranged astern of the gear arrangement 4. In one or more embodiments of the present invention, the electromotor 3 will form an angle in relation to the gear arrangement 4, when seen in relation to the horizontal base plane H. The gear arrangement 4 then comprises an angular gear 12, as shown in FIG. 5, where the angular gear 12 will be explained in more detail in connection with this figure.

In one or more of the illustrated embodiments in FIGS. 2A-2D, the gear arrangement 4 will be arranged in the convexity or in the addition 10 in the hull 2. The convexity or addition 10 will then so be configured (not shown) as to ensure access to the gear arrangement 4 that is arranged in the convexity or addition 10, in such a way that maintenance, replacement, repairs etc. of the gear arrangement 4 can be carried out.

It should be understood that although it has been described with respect to one sub-system 100 comprising a propeller 7, a gear arrangement 4 and at least one electromotor 3 according to one or more embodiments of the present invention, the propeller propulsion system according to FIGS. 2A-2D may also comprise a plurality of sub-systems 100 as shown in FIG. 1, where two sub-systems 100 are arranged lying out against the sides of the vessel 1.

From FIGS. 2A-2D it will also be seen that the gear arrangement 4 and the intermediate shaft 6 will foil it an angle relative to the horizontal base plane H.

Figure 3:
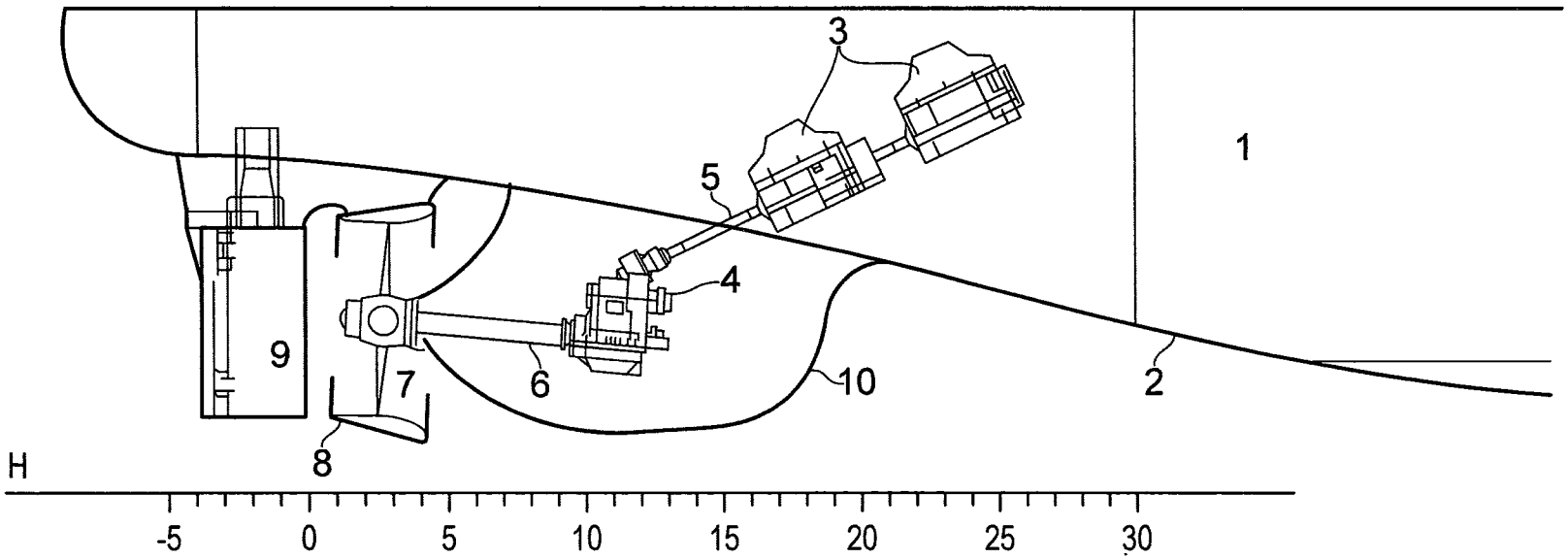
FIG. 3 shows in greater detail the propeller propulsion system according to FIG. 2C.

FIG. 3 shows in greater detail the propeller propulsion system according to FIG. 2C, where it is seen that the gear arrangement 4, the intermediate shaft 6 and the propeller 7, located in the propeller shroud 8, may be arranged at an angle relative to the horizontal base plane H, so that the distance between the intermediate shaft 6 and the horizontal base plane H increases from the gear arrangement 4 towards the stern end of the vessel 1. The rudder 9 is a conventional rudder, which is suitably connected to the vessel's 1 steering and manoeuvring devices (not shown). The electromotors 3 are through suitable transmissions and connections arranged in series so that they form an extension of the intermediate shaft 5. The electromotors 3 will further form an angle relative to the gear arrangement 4 and the electromotors 3 are arranged ahead of the gear arrangement 4.

FIG. 4 shows an angular gear 11 that is used in the gear arrangement 4 according to the propeller propulsion system shown in FIG. 2A, where the angular gear 11 has two incoming shafts 51, and one outgoing shaft 61. The incoming and outgoing shafts 51, 61 are configured with connecting devices (not shown), to which connecting devices the intermediate shafts 5, 6 are suitably connected. This will mean that each electromotor 3 is connected through the intermediate shaft 5 to the incoming shaft 51 of the angular gear 11, whilst the intermediate shaft 6 at one end thereof will be connected to the outgoing shaft 61 of the angular gear 11, and at the other end thereof is connected to a hub of the propeller 7. The gear arrangement 4 consists of a gear case 41 in which each incoming shaft 51 is connected to outgoing shaft 61 through one angled and one cylindrical gearwheel set 42, 43 mounted on respective shafts 44, 45 and may be supported by sliding bearings (not shown). The pushing and pulling forces of the propeller 7 will thus be transmitted through shaft 61 to the gear arrangement 4 containing sliding bearings which relay the forces through the gear case 41 to the vessel's 1 hull 2.

One of the cylindrical gearwheels 431 in the cylindrical gearwheel set 43 will be fixedly connected to the shaft 45, which constitutes the outgoing shaft 61 of the angular gear 11, whilst the other cylindrical gearwheel 432 will be fixedly connected to the intermediate shaft 44 in the gear case 41. Two angled gearwheels 421 in the angled gearwheel set 42 are also fixedly connected to the intermediate shaft 44. The two other angled gearwheels 422 will be fixedly connected to their respective shaft which constitutes the incoming shaft 51 of the angular gear. In this way, the gearwheels 431, 432 in the cylindrical gearwheel set 43 will be in contact with each other, whilst the gearwheels 421, 422 in each of the angled gearwheel sets 42 will be in contact with each other. The shafts 44, 45 may for example be supported by sliding bearings or the like. Through the design of the angular gear 11 described above, an unequal loading of the different gearwheels will be prevented to a far greater extent, as the cylindrical gearwheel set 43 is arranged on the outgoing shaft 61 of the angular gear 11. The pushing and pulling forces of the propeller 7 will mean that the outgoing shaft 61 is moved in its axial longitudinal direction, whereby also the gearwheels 431, 432 in the cylindrical gearwheel set 43 will be displaced relative to each other. As the gearwheels 431,432 in the cylindrical gearwheel set 43, because of their design, will be capable of being subjected to greater loads without being worn or damaged, the angular gear 11 will to a far lesser extent have to be maintained, replaced or repaired.

Another angular gear 12, which is used in the gear arrangement 4 according to the embodiments of the propeller propulsion system as shown in FIGS. 2C and 2D, is shown in FIG. 5. In this case, the angular gear 12 will comprise an incoming shaft 51 and an outgoing shaft 61. The incoming and outgoing shafts 51, 61 are configured with connecting means (not shown), to which connecting means the intermediate shafts 5, 6 are suitably connected. This will mean that each electromotor 3 is connected through the intermediate shaft 5 to the incoming shaft 51 of the angular gear 12, whilst the intermediate shaft 6 at one end thereof will be connected to outgoing shaft 61 of the angular gear 12 and at the other end thereof is connected to a hub of the propeller 7. The gear arrangement 4 consists of a gear case 41, where each incoming shaft 51 is connected to outgoing shaft 61 through one angled and one cylindrical gearwheel set 42, 43 mounted on respective shafts 44, 45 and may be supported by sliding bearings (not shown). The pushing and pulling forces of the propeller 7 will thus be transmitted through shaft 6 via outgoing shaft 61 to gear arrangement 4 containing sliding bearings which relay the forces through gear case 41 to the vessel's 1 hull 2.

One of the cylindrical gearwheels 431 in the cylindrical gearwheel set 43 will then be fixedly connected to the shaft 45, which constitutes the outgoing shaft 61 of the angular gear 11, whilst the other cylindrical gearwheel 432 will be fixedly connected to the intermediate shaft 44 in the gear case 41. An angled gearwheel 421 in the angled gearwheel set 42 is also fixedly connected to the intermediates shaft 44. The other angled gearwheel 422 will be fixedly connected to the incoming shaft 51 of the angular gear 12. In this way, the gearwheels 431, 432 in the cylindrical gearwheel set 43 will be in contact with each other, whilst the gearwheels 421, 422 in the angled gearwheel set 42 will be in contact with each other. Through the design of the angular gear described above, an unequal loading of the different gearwheels will be prevented to a far greater extent, as the cylindrical gearwheel set 43 is arranged on the outgoing shaft 61 of the angular gear 12. The pushing and pulling forces of the propeller 7 will mean that the outgoing shaft 61 is moved in its axial longitudinal direction whereby also the gearwheels 431, 432 in the cylindrical gearwheel set 43 will be displaced relative to each other. As the gearwheels 431, 432 in the cylindrical gearwheel set 43, because of their design, will be capable of being subjected to greater loads without being worn or damaged, the angular gear 12 will to a far lesser extent have to be maintained, replaced or repaired.

The invention has now been explained with reference to several embodiments. A person of skill in the art will understand that it is possible to make several changes and modifications to the illustrated embodiments which fall within the scope of the invention as defined in the following claims.

The invention claimed is:

1. A floating structure comprising:

a hull;

a propeller propulsion system comprising a gear arrangement that is connected via a first intermediate shaft to at least one electromotor, the electromotor being arranged onboard the floating structure, and via a second intermediate shaft to a propeller, wherein the gear arrangement comprises an angular gear, wherein the first intermediate shaft forms an angle relative to the second intermediate shaft, wherein the gear arrangement is arranged as a separate unit entirely in one appendage or addition to the hull of the floating structure, the one appendage or addition is formed entirely of a single structure, wherein the appendage or addition is designed to allow an interior thereof to be accessed from within the vessel without removal of the appendage, whereby maintenance, replacement, or repairs of the gear arrangement can be carried out, wherein the angular gear comprises at least one angled gearwheel set and one cylindrical gearwheel set, wherein a first cylindrical gearwheel of the cylindrical gearwheel set and a first angled gearwheel of the angled gearwheel set are connected to a third intermediate shaft, wherein a second angled gearwheel of the angled gearwheel set is connected to an incoming shaft, wherein the incoming shaft is connected to the first intermediate shaft, and wherein a second cylindrical gearwheel of the cylindrical gearwheel set is connected to the second intermediate shaft, via a connection shaft.

2. The propeller propulsion system according to claim 1, wherein the angular gear is connected to the incoming shaft and the connection shaft.

3. The propeller propulsion system according to claim 1, wherein the incoming shaft comprises two incoming shafts that are arranged forming an angle to one another.

4. The propeller propulsion system according to claim 1, wherein a distance in height between the second intermediate shaft and a horizontal base plane increases from the gear arrangement towards one end of the floating structure.

5. The propeller propulsion system according to claim 2, wherein the incoming shaft comprises two incoming shafts that are arranged arming an angle to one another.

* * * * *